US008892010B2

(12) United States Patent
Okoshi et al.

(10) Patent No.: US 8,892,010 B2
(45) Date of Patent: Nov. 18, 2014

(54) DEVELOPING DEVICE AND IMAGE FORMING APPARATUS

(75) Inventors: Takeshi Okoshi, Kanagawa (JP); Keisuke Kubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 83 days.

(21) Appl. No.: 13/607,113

(22) Filed: Sep. 7, 2012

(65) Prior Publication Data

US 2013/0195516 A1 Aug. 1, 2013

(30) Foreign Application Priority Data

Jan. 27, 2012 (JP) ..... 2012-015629

(51) Int. Cl.
*G03G 15/08* (2006.01)

(52) U.S. Cl.
USPC ..... 399/279; 399/269

(58) Field of Classification Search
USPC ..... 399/279
See application file for complete search history.

(56) References Cited

U.S. PATENT DOCUMENTS 5,471,286 A * 11/1995 Tanaka ..... 399/167
2002/0181974 A1 12/2002 Sekiguchi
2003/0198490 A1 10/2003 Sugiyama
2010/0119259 A1* 5/2010 Katayama ..... 399/159

FOREIGN PATENT DOCUMENTS

| | | | |
|---|---|---|---|
| JP | 2002-351211 | A | 12/2002 |
| JP | 2002-357951 | A | 12/2002 |
| JP | 2003-149943 | A | 5/2003 |
| JP | 2003-307930 | A | 10/2003 |

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A developing device includes two developer-transporting members, a container, and four gap retainers. The container contains a developer and rotatably supports rotation shafts of the developer-transporting members using side walls located on both end portions. The gap retainers are supported at end portions of the developer-transporting members and are brought into contact with a subjected-to-development member or a supporter to maintain a gap between the subjected-to-development member and each developer-transporting member. A force with which the two developer-transporting members are pressed toward the subjected-to-development member is applied to the container and all the gap retainers are brought into contact with the subjected-to-development member or the supporter, while axes of rotation of the two developer-transporting members are allowed to become non-parallel with an axis of rotation of the subjected-to-development member.

9 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-015629 filed Jan. 27, 2012.

BACKGROUND

The present invention relates to developing devices and image forming apparatuses.

SUMMARY

According to an aspect of the invention, a developing device includes two developer-transporting members that are arranged side by side such that circumferential surfaces of the developer-transporting members face a cylindrical subjected-to-development member that is rotatably supported by a supporter, each of the developer-transporting members rotating in a circumferential direction of the circumferential surface while carrying a developer on the circumferential surface to transport the developer to a surface of the subjected-to-development member, on which an electrostatic latent image is formed and then developed with the developer, a container that contains the developer transported by the two developer-transporting members, the container rotatably supporting rotation shafts of the two developer-transporting members using side walls of the container located on both end portions in a direction in which the two developer-transporting members extend, and four gap retainers that are supported at both end portions of the two developer-transporting members, the gap retainers being brought into contact with the subjected-to-development member or the supporter to each maintain a gap between the subjected-to-development member and a corresponding one of the developer-transporting members. In the developing device, a force with which the two developer-transporting members are pressed toward the subjected-to-development member is applied to the container and all the four gap retainers are brought into contact with the subjected-to-development member or the supporter, while axes of rotation of the two developer-transporting members are allowed to become non-parallel with an axis of rotation of the subjected-to-development member.

BRIEF DESCRIPTION OF THE DRAWINGS

Exemplary embodiments of the present invention will be described in detail based on the following figures, wherein:

FIG. 5A is a left-side view, FIG. 5B is a cross-sectional view, and FIG. 5C is a right-side view;

FIG. 8A is a left-side view, FIG. 8B is a cross-sectional view, and FIG. 8C is a right-side view.

DETAILED DESCRIPTION

Figure 1:
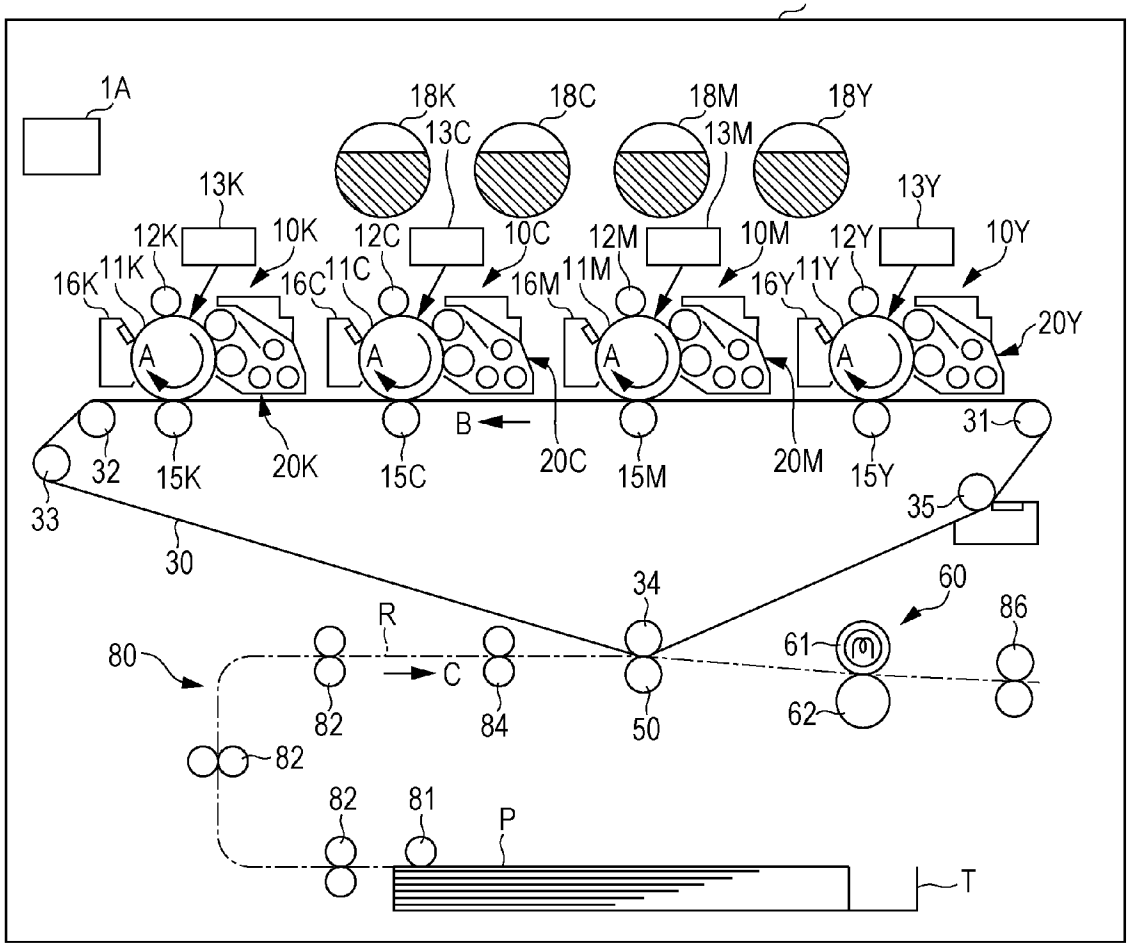
FIG. 1 is a configuration diagram illustrating an image forming apparatus according to an exemplary embodiment of the invention.

Referring to the drawings, exemplary embodiments of the invention will be described below.

FIG. 1 is a configuration diagram illustrating an image forming apparatus 1 according to an exemplary embodiment of the invention.

The image forming apparatus 1 illustrated in FIG. 1 is a tandem color printer in which image forming units 10Y, 10M, 10C, and 10K for corresponding colors of yellow (Y), magenta (M), cyan (C), and black (K) are arranged side by side. The image forming apparatus 1 is capable of printing not only a single-color image but also a full-color image constituted by toner images of four colors. Toner cartridges 18Y, 18M, 18C, and 18K respectively contain toners of the colors of Y, M, C, and K.

Since the four image forming units 10Y, 10M, 10C, and 10K have almost the same configuration, the image forming unit 10Y corresponding to yellow (Y) is exemplarily described. The image forming unit 10Y includes a photoconductor drum 11Y, a charging device 12Y, an exposing device 13Y, a developing device 20Y, and a first transfer device 15Y. The image forming unit 10Y also includes a photoconductor cleaner 16Y that cleans the photoconductor drum 11Y. The photoconductor drum 11Y, the charging device 12Y, the exposing device 13Y, the developing device 20Y, and the first transfer device 15Y are supported by a body housing F that supports the entirety of the image forming apparatus 1. The developing device 20Y is an exemplary developing device in the invention, and the photoconductor drum 11Y is an exemplary subjected-to-development member in the invention.

The photoconductor drum 11Y is formed by disposing a photoconductor layer on a cylindrical base. The photoconductor drum 11Y rotates around an axis of the cylindrical base or in a direction of the arrow A while carrying an image on its surface. The charging device 12Y, the exposing device 13Y, the developing device 20Y, the first transfer device 15Y, and the photoconductor cleaner 16Y are arranged around the photoconductor drum 11Y in order in the direction of the arrow A.

The charging device 12Y is a device that charges the surface of the photoconductor drum 11Y. The charging device 12Y is a charging roller that contacts the surface of the photoconductor drum 11Y. A voltage that has the same polarity as a toner contained in the developing device 20Y is applied to the charging roller, and the charging roller charges the surface of the photoconductor drum 11Y by contacting it. The exposing device 13Y forms an electrostatic latent image by exposing the surface of the photoconductor drum 11Y to light. The exposing device 13Y emits a laser beam based on an image signal supplied from the outside of the image forming apparatus 1 and scans the surface of the photoconductor drum 11Y with the laser beam.

The developing device 20Y develops the surface of the photoconductor drum 11Y with a developer. A toner is supplied from the toner cartridge 18Y to the developing device 20Y. The developing device 20Y agitates a developer in which a magnetic carrier and a toner are mixed so that the toner and the magnetic carrier become charged, and develops the electrostatic latent image on the surface of the photoconductor drum 11Y with the charged toner.

The first transfer device 15Y is a roller that faces the photoconductor drum 11Y with the intermediate transfer belt 30 interposed therebetween. When a voltage is applied between the first transfer device 15Y and the photoconductor drum 11Y, the first transfer device 15Y transfers a toner image formed on the photoconductor drum 11Y to an intermediate transfer belt 30. The photoconductor cleaner 16Y cleans the surface of the photoconductor drum 11Y by removing remnants such as a toner remaining on the surface of the photoconductor drum 11Y after a transfer operation.

The image forming apparatus 1 also includes the intermediate transfer belt 30, a fixing device 60, a sheet transporting unit 80, and a controller 1A. The intermediate transfer belt 30 is an endless belt wrapped around belt supporting rollers 31 to 35. The intermediate transfer belt 30 rotates in a direction of the arrow B via the image forming units 10Y, 10M, 10C, and 10K and a second transfer device 50. Toner images of different colors are transferred from the image forming units 10Y, 10M, 10C, and 10K to the intermediate transfer belt 30. The intermediate transfer belt 30 moves while carrying the toner images of these colors.

The second transfer device 50 is a roller that rotates while nipping the intermediate transfer belt 30 and a sheet P between itself and a back-up roller 34, which is one of the belt supporting rollers 31 to 35. The second transfer device 50 includes an electrically conductive elastic layer on the surface. When a voltage that has a polarity opposite to that of a toner is applied to the second transfer device 50, the second transfer device 50 transfers the toner image formed on the intermediate transfer belt 30 to a sheet P.

The fixing device 60 is used to fix the toner image on a sheet P to the sheet P. The fixing device 60 includes a heating roller 61 and a compressing roller 62, and the heating roller 61 contains a heating device. The heating roller 61 and the compressing roller 62 cause a sheet P having a toner image formed thereon to pass therethrough while nipping the sheet P so that the toner image is fixed to the sheet P.

The sheet transporting unit 80 includes a pick-up roller 81 that picks up sheets P contained in the sheet container T, transporting rollers 82 that transport the sheets P, registration rollers 84 that transport the sheets P to the second transfer device 50, and ejecting rollers 86 that eject the sheets P to the outside. The sheet transporting unit 80 transports the sheets P along a sheet transport path R along which the sheets P pass the second transfer device 50 and the fixing device 60.

A fundamental operation of the image forming apparatus 1 illustrated in FIG. 1 will be described now. In the image forming unit 10Y corresponding to yellow, the photoconductor drum 11Y rotates in the direction of the arrow A and the surface of the photoconductor drum 11Y is charged by the charging device 12Y. The exposing device 13Y irradiates the surface of the photoconductor drum 11Y with exposure light based on an image signal corresponding to yellow among image signals supplied from the outside in order to form an electrostatic latent image on the surface of the photoconductor drum 11Y. The developing device 20Y receives a supply of a yellow toner from the toner cartridge 18Y and develops the electrostatic latent image formed on the photoconductor drum 11Y with the toner into a toner image. The photoconductor drum 11Y rotates while carrying the yellow toner image on its surface. The toner image formed on the surface of the photoconductor drum 11Y is transferred to the intermediate transfer belt 30 by the first transfer device 15Y. After the toner image is transferred, a toner remaining on the photoconductor drum 11Y is removed by the photoconductor cleaner 16Y.

The intermediate transfer belt 30 rotates in the direction of the arrow B. Like the image forming unit 10Y, the image forming units 10M, 10C, and 10K for colors other than yellow form toner images of the corresponding colors and transfer the toner images of the corresponding colors to the intermediate transfer belt 30 such that the toner images are superposed on the toner image having been transferred by the image forming unit 10Y.

The pick-up roller 81 picks up a sheet P from the sheet container T. The transporting rollers 82 and the registration rollers 84 transport the sheet P in the direction of the arrow C along the sheet transport path R toward the second transfer device 50. The registration rollers 84 feed the sheet P to the second transfer device 50 in consideration of timings when the toner images are transferred to the intermediate transfer belt 30. The second transfer device 50 produces an electric field between the intermediate transfer belt 30 and the sheet P to transfer the toner images formed on the intermediate transfer belt 30 to the sheet P. The sheet P to which the toner images have been transferred is transported to the fixing device 60, and the toner images are fixed to the sheet P by the fixing device 60. In this manner, an image is formed on the sheet P. The sheet P having the image formed thereon is ejected by the ejecting rollers 86 to the outside of the image forming apparatus 1.

Developing Device

Figure 2:
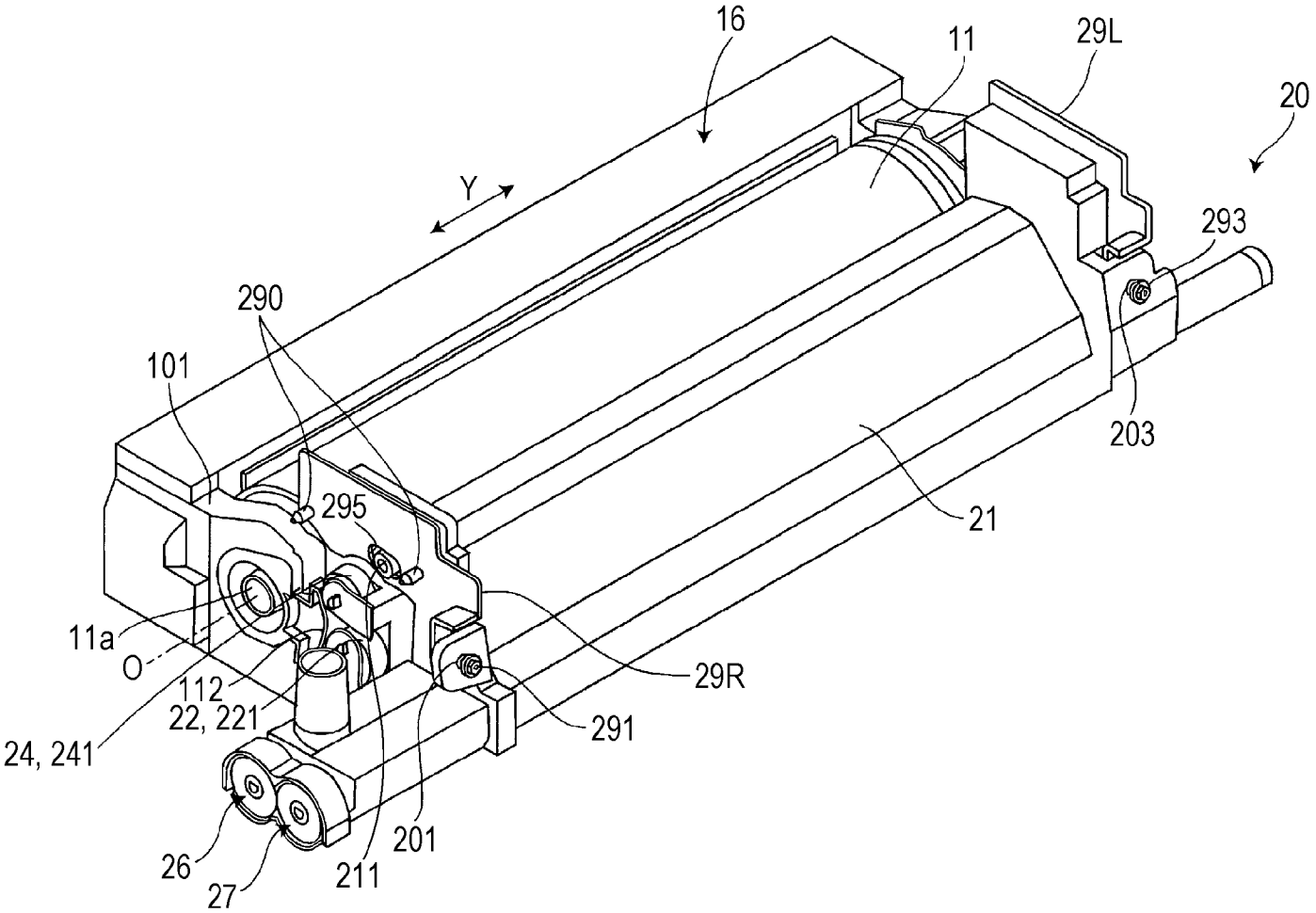
FIG. 2 is a perspective view of the developing device illustrated in FIG. 1.
Figure 3:
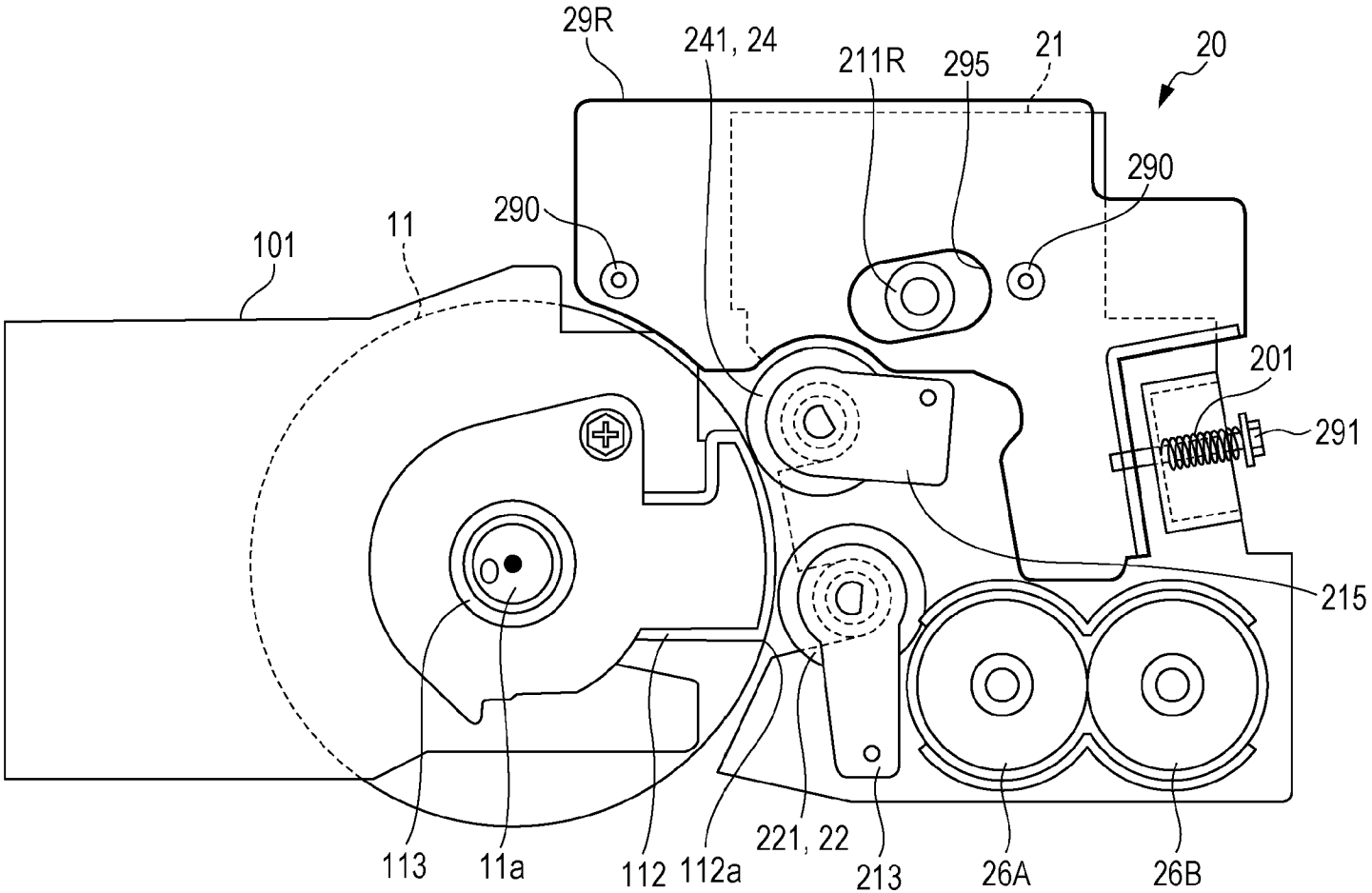
FIG. 3 is a side view of the developing device.

FIG. 2 is a perspective view of the developing device 20 illustrated in FIG. 1. Besides the developing device 20, FIG. 2 also illustrates a photoconductor drum 11 and a photoconductor cleaner 16. FIG. 3 is a side view of the developing device 20. Besides the developing device 20, FIG. 3 also illustrates the photoconductor drum 11. Since the same configuration, illustrated in FIG. 2 and FIG. 3, is used for all the colors of Y, M, C, and K, developing devices, photoconductor drums, and photoconductor cleaners will be hereinafter denoted by simple reference numerals 20, 11, and 16, respectively.

The photoconductor drum 11, the photoconductor cleaner 16, and the developing device 20 are supported by a body housing F (see FIG. 1) of the image forming apparatus 1. The photoconductor drum 11 is supported by the body housing F (see FIG. 1) so as to be rotatable around an axis O of rotation. More specifically, shaft portions 11*a* of the photoconductor drum 11 are supported by drum supporters 101, which are secured to the body housing F, via bearings 113. Positioning members 112 are also attached to the drum supporters 101. The body housing F, the drum supporters 101, and the positioning members 112 are exemplary supporters in the invention.

The developing device 20 includes a container 21 and two support frames 29L and 29R. The support frames 29L and 29R are secured to the body housing F. The support frames 29L and 29R each include engaging projections 290 that engage with the body housing F (see FIG. 1). The support frames 29L and 29R are exemplary fixed members in the invention.

The container 21 contains a developer and supports components of the developing device 20. The container 21 has a fundamental structure in which a lid is attached to an upper portion of a rigidly structured container body, in which side panels and a bottom panel are integrated into a single unit by resin molding. Side walls 21L and 21R of the container 21 respectively have support projections 211L and 211R. The support projections 211L and 211R are respectively inserted in holes formed in the support frames 29L and 29R. FIG. 3 illustrates a surface of the developing device 20 that is located on the right side of the photoconductor drum 11, i.e., a surface of the developing device 20 that faces an operator when the developing device 20 is installed in the image forming apparatus 1. The right support frame 29R illustrated in FIG. 3 has a wide hole 295, in which the support projection 211R is inserted. In the exemplary embodiment, the wide hole 295 of the right support frame 29R and a hole of the left support frame 29L have different shapes, which will be described below.

The developing device 20 also includes two spring members 201 and 203 that press the container 21 against the photoconductor drum 11. The spring members 201 and 203 are exemplary pressing members in the invention. Each of the spring members 201 and 203 is interposed between the container 21 and a corresponding one of the support frames 29L and 29R. More specifically, the adjustment screw 291 engages with the right support frame 29R, and the spring member 201 is interposed between the adjustment screw 291 and the container 21. The adjustment screw 293 engages with the left support frame 29L, and the spring member 203 is interposed between the adjustment screw 293 and the container 21. The spring members 201 and 203 are compressing springs and press the container 21 against the photoconductor drum 11. FIG. 3 also illustrates tracking rollers 221 and 241 that are brought into contact with the positioning member 112 when the container 21 is pressed against the photoconductor drum 11.

Figure 4:
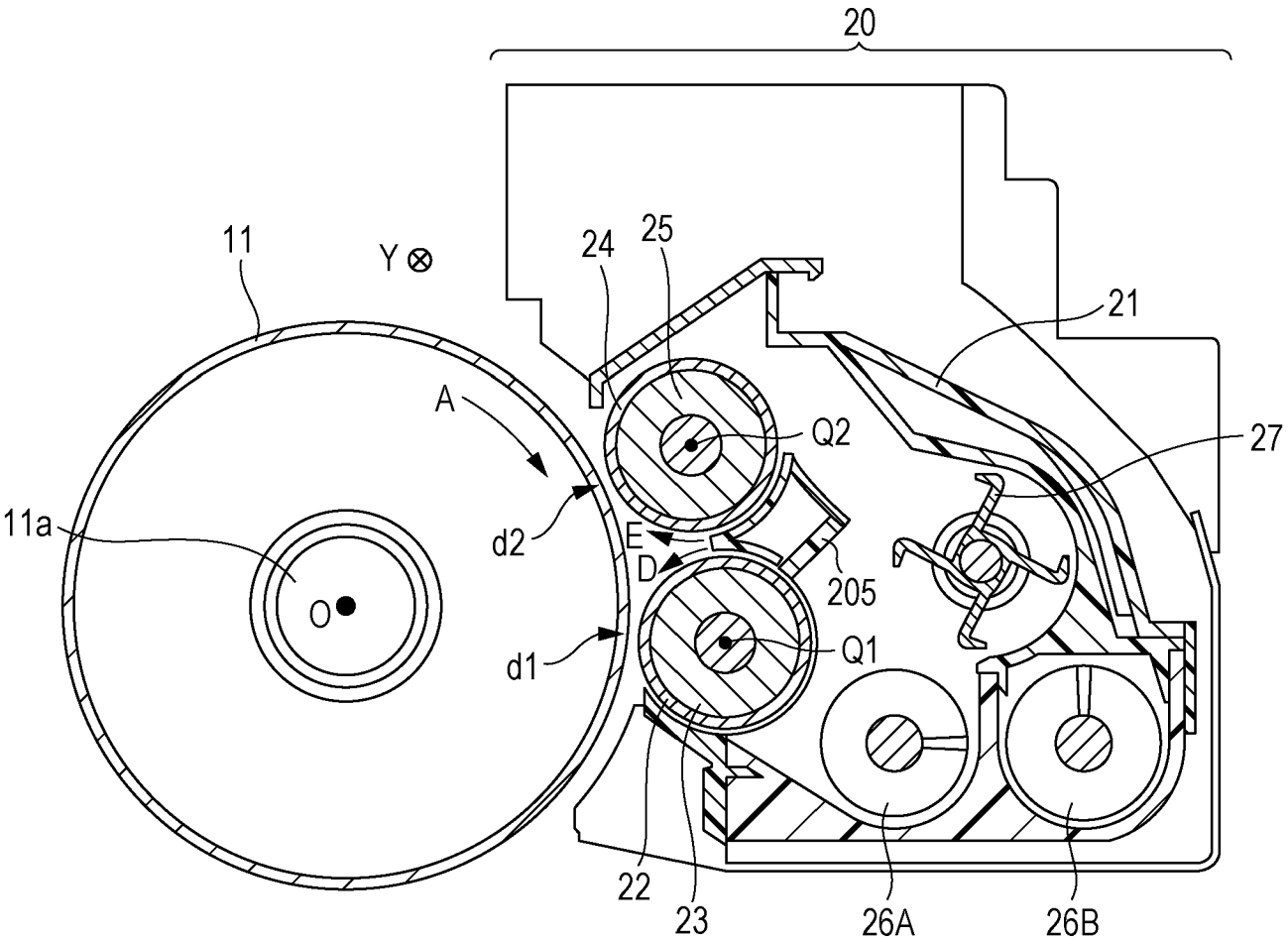
FIG. 4 is a cross-sectional view illustrating an internal configuration of the developing device illustrated in FIG. 2 and FIG. 3.
Figure 5A:
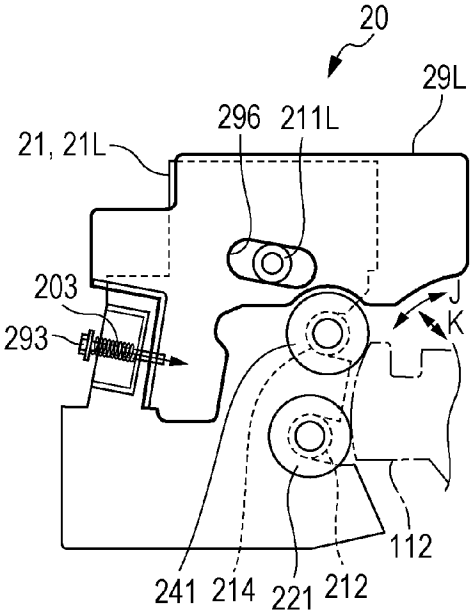
FIGS. 5A, 5B, and 5C illustrate a support structure of the developing device illustrated in FIG. 2, where
Figure 5B:
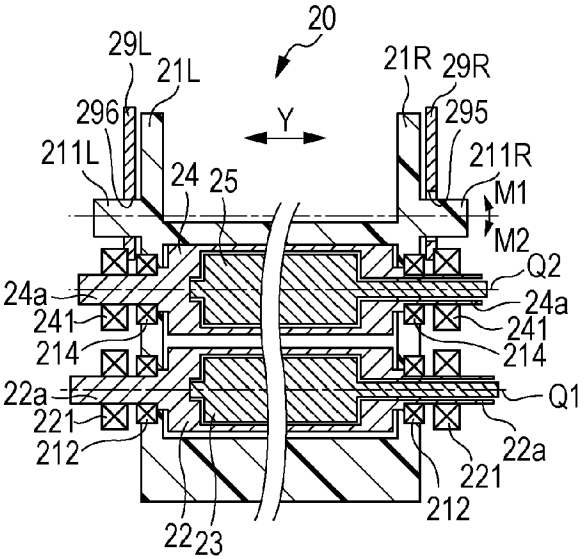
Figure 5C:
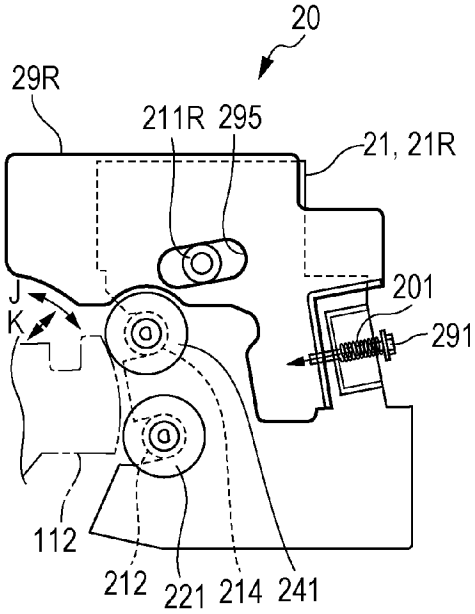

FIG. 4 is a cross-sectional view illustrating an internal structure of the developing device 20 illustrated in FIG. 2 and FIG. 3. FIGS. 5A, 5B, and 5C illustrate a support structure of the developing device 20 illustrated in FIG. 2, where FIG. 5A is a left-side view, FIG. 5B is a cross-sectional view of the development rollers 22 and 24 and the support projections 211, and FIG. 5C is a right-side view.

The container 21 of the developing device 20 contains a first development roller 22, a first magnet 23, a second development roller 24, a second magnet 25, a first agitating member 26A, a second agitating member 26B, and a paddling member 27. The first development roller 22 and the second development roller 24 are exemplary developer-transporting members in the invention. The tracking rollers 221 and 241 are exemplary gap retainers in the invention.

The first development roller 22 and the second development roller 24 transport the developer contained in the container 21 to the surface of the photoconductor drum 11 by rotating. The first development roller 22 and the second development roller 24 have a cylindrical shape extending in the extension directions Y parallel with the photoconductor drum 11, and are arranged side by side such that their circumferential surfaces face the photoconductor drum 11. The first development roller 22 faces the photoconductor drum 11 in a first development region d1 and the second development roller 24 faces the photoconductor drum 11 in a second development region d2. Shaft portions 22*a* located on both ends of the first development roller 22 in the extension directions Y are rotatably supported by side walls 21L and 21R located at both end portions of the container 21 in the extension directions Y via bearing members 212. Shaft portions 24*a* of the second development roller 24 are also rotatably supported by side walls 21L and 21R via bearing members 214. Tracking rollers 221 and 241 are mounted on the shaft portions 22*a* and 24*a* of the first development roller 22 and the second development roller 24. As described referring to FIG. 3, when the container 21 is pressed toward the photoconductor drum 11 by the spring members 201 and 203, the tracking rollers 221 and 241 are brought into contact with the positioning member 112 of the photoconductor drum 11. Thus, a predetermined gap between the photoconductor drum 11 and each of the first and second development rollers 22 and 24 is maintained. Consequently, the density of a toner image formed on the photoconductor drum 11 is maintained within a predetermined range.

The first development roller 22 is located downstream from the second development roller 24 in a direction of movement of the circumferential surface of the photoconductor drum 11, which rotates in the direction of the arrow A. The first magnet 23 is located inside the first development roller 22 and attracts the developer to the first development roller 22. The second magnet 25 is located inside the second development roller 24 and attracts the developer to the second development roller 24. The first magnet 23 and the second magnet 25 are secured to the container 21 by securing members 213 and 215 (see FIG. 3). The securing members 213 and 215 are not illustrated in FIGS. 5A, 5B, and 5C so that the positions of the first and second development rollers 22 and 24 are easily seen. The first development roller 22 rotates in the direction of the arrow D, while the second development roller 24 rotates in the direction of the arrow E that is opposite to the direction in which the first development roller 22 rotates. In other words, the first development roller 22 and the second development roller 24 rotate such that opposing portions of their circumferential surfaces move in the same direction. A portion of the circumferential surface of the first development roller 22 that faces the photoconductor drum 11 in the first development region d1 moves in the same direction as the opposing portion of the circumferential surface of the photoconductor drum 11. A portion of the circumferential surface of the second development roller 24 that faces the photoconductor drum 11 in the second development region d2 moves in the opposite direction from the opposing portion of the circumferential surface of the photoconductor drum 11.

The first agitating member 26A and the second agitating member 26B agitate the developer contained in the container 21. The first agitating member 26A and the second agitating member 26B have a structure in which a helical blade is helically formed on the rotation shaft that extends in the extension directions Y. The first agitating member 26A and the second agitating member 26B are arranged so as to be adjacent to each other, and the first agitating member 26A is located adjacent to the first development roller 22. The first agitating member 26A and the second agitating member 26B transport the developer in opposing extension directions Y by rotating. The developer is circulated in the container 21 while being agitated by the first agitating member 26A and the second agitating member 26B. The toner and the magnetic carrier in the developer become charged by being agitated.

The developer transported by the first agitating member 26A is attracted to the first development roller 22, supported on the first development roller 22, and moves in the direction of the arrow D of the first development roller 22. A plate-like thickness regulating member 205 is disposed at a portion over the circumferential surface of the first development roller 22 and between the first agitating member 26A and the second development roller 24. The thickness or the amount of the developer on the first development roller 22 to be transported is regulated by the thickness regulating member 205 and, thereafter, part of the developer is transferred to the second development roller 24. The part of the developer transferred to the second development roller 24 is carried on the second development roller 24 and transported to the photoconductor drum 11 in the second development region d2. The developer remaining on the first development roller 22 is transported to the photoconductor drum 11 in the first development region d1. When the toner in the developer adheres to the electrostatic latent image on the photoconductor drum 11, a toner image is formed. The photoconductor drum 11 comes into contact with the developer twice, i.e., in the second development region d2 and the first development region d1. Part of the developer remaining after the rest of the developer has adhered to the photoconductor drum 11 in the first development region d1 is transported by the first development roller 22 back to the first agitating member 26A. Part of the developer remaining after the rest of the developer has adhered to the photoconductor drum 11 in the second development region d2 is transported by the second development roller 24 and then recovered by the paddling member 27 back to the first agitating member 26A.

Support Structure of Support Frames and Container

As illustrated in FIGS. 5A, 5B, and 5C, in the developing device 20 according to this exemplary embodiment, the support projections 211L and 211R formed on the side walls 21L and 21R at both end portions of the container 21 in the extension direction Y are respectively inserted into the holes 295 and 296 that are formed in the support frames 29L and 29R. More specifically, as illustrated in FIG. 5A, the support projection 211L formed on the left side wall 21L of the container 21 is inserted into a long hole 296 formed in the left support frame 29L. The long hole 296 longitudinally extends toward the photoconductor drum 11 and has a width that is equivalent to the diameter of the support projection 211L. Thus, the left support projection 211L is movable toward the photoconductor drum 11 in a drum direction K but is not movable in the circumferential direction J of the photoconductor drum 11. On the other hand, as illustrated in FIG. 5B, the support projection 211R formed on the right side wall 21L of the container 21 is inserted in the wide hole 295 formed in the right support frame 29R. The wide hole 295, which is so-called a clearance hole, longitudinally extends toward the photoconductor drum 11 and has a width, extending in the circumferential direction J of the photoconductor drum 11, that is larger than the diameter of the support projection 211R. For this reason, the right support projection 211R is movable both in the drum direction K and the circumferential direction J.

Since the left side wall 21L is restricted from moving in the circumferential direction J by the support frame 29L while the right side wall 21R is allowed to move in the circumferential direction J by the wide hole 295, the entirety of the container 21 is capable of inclining so as to rotate in the directions of the arrows M1 and M2, illustrated in FIG. 5B, around the support projection 211L of the left side wall 21L. As described above, the container 21 supports shaft portions 22*a* and 24*a*, formed at both end portions of the first development roller 22 and the second development roller 24, using the side walls 21L and 21R. Thus, the support frames 29L and 29R support the container 21 while allowing axes Q1 and Q2 of rotation of the development rollers 22 and 24 to become non-parallel with the axis O of rotation of the photoconductor drum 11.

The tracking rollers 221 are disposed on both end portions of the first development roller 22 in the extension direction Y and the tracking rollers 241 are disposed on both end portions of the second development roller 24. A force with which the first development roller 22 and the second development roller 24 are pressed toward the photoconductor drum 11 is applied to the container 21 by the spring members 201. Positioning of the container 21 is made by bringing the tracking rollers 221 of the first development roller 22 and the tracking rollers 241 of the second development roller 24 into contact with the corresponding positioning members 112.

If, for example, the container 21 moves only in the drum direction K along the long hole 296, one of the four tracking rollers 221 and 241 may be separated from the corresponding positioning member 112 due to tolerances while the remaining three tracking rollers 221 and 241 are brought into contact with the corresponding positioning members 112. Here, the tolerances include tolerances relating to dimensions of individual products, such as the body housing F, the photoconductor drum 11, the developing device 20 of the image forming apparatus 1, and tolerances relating to positions at and orientations in which the photoconductor drum 11 and the developing device 20 are installed. FIGS. 5A and 5C illustrate the state where the tracking roller 221 located on the right side of the first development roller 22 among the four tracking rollers 221 and 241 is separated from the corresponding positioning member 112.

In the developing device 20 according to the exemplary embodiment, when the axes Q1 and Q2 of rotation of the two development rollers 22 and 24 become non-parallel with the axis O of rotation of the photoconductor drum 11, all the four tracking rollers 221 and 241 are brought into contact with curved surfaces of the positioning members 112. More specifically, when the entirety of the container 21 is inclined in the direction of the arrow M1 or M2, illustrated in FIG. 5B, around the support projection 211L of the left side wall 21L, all the four tracking rollers 221 and 241 are brought into contact with the positioning members 112. Here, the axes Q1 and Q2 of rotation of the two development rollers 22 and 24 supported by the container 21 become non-parallel with the axis O of rotation of the photoconductor drum 11. In the example illustrated in FIG. 5C, a right portion of the container 21 is lifted upward by a component of force, whose direction is upward in the circumferential direction J, among components of force through which the right tracking roller 241 (see FIG. 5C) is brought into contact with the positioning member 112. Accordingly, the container 21 is inclined in the direction of the arrow M1. Consequently, the tracking roller 221 (see FIG. 5C) is also brought into contact with the positioning member 112.

Figure 6:
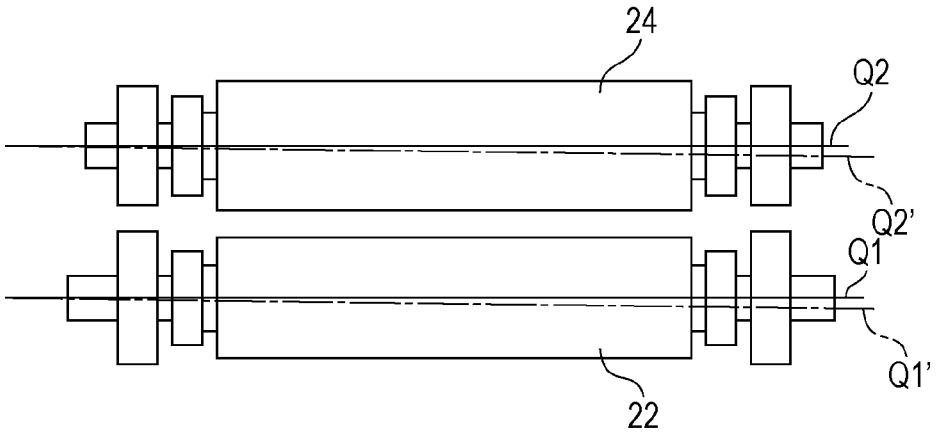
FIG. 6 illustrates exemplary positions of a first development roller and a second development roller.

FIG. 6 illustrates examples of positions of the first development roller 22 and the second development roller 24.

The axes Q1 and Q2 of rotation of the first development roller 22 and the second development roller 24 are respectively deviated from lines Q1' and Q2', which are in parallel with the axis O of rotation of the photoconductor drum 11. When the two development rollers 22 and 24 are inclined as illustrated in FIG. 6, all the four tracking rollers 221 and 241 are brought into contact with the corresponding positioning members 112 (see FIG. 5) while deviations due to the above-mentioned allowances are absorbed. Thus, a predetermined gap between the photoconductor drum 11 and each of the first and second development rollers 22 and 24 is maintained. Consequently, the density of the toner image formed on the photoconductor drum 11 is maintained within a predetermined range.

In the developing device 20 according to this exemplary embodiment, all the end portions of the first and second development rollers 22 and 24 are directly supported by the container 21 via the bearing members 212 and 214. Thus, the developing device 20 includes fewer components than in the case, for example, where the developing device 20 has a supporting mechanism that moves while supporting an end portion of a development roller or a function of preventing a toner from leaking out of a movable portion.

Second Exemplary Embodiment

Next, description will be given on a developing device 220 according to a second exemplary embodiment of the invention that does not use compression by a spring member unlike the developing device 20. In the following description of the second exemplary embodiment, components that are the same as those in the first exemplary embodiment are denoted by the same reference symbols and only the points that are different from those of the above-described exemplary embodiments will be described.

Figure 7:
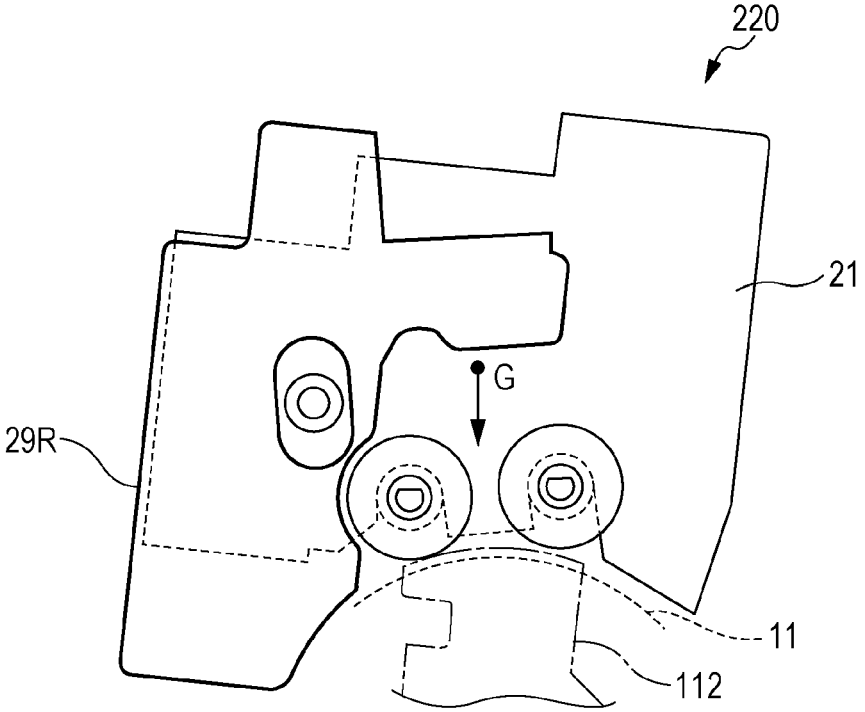
FIG. 7 is a right-side view illustrating a support structure of a developing device according to a second exemplary embodiment.

FIG. 7 is a right-side view illustrating a support structure of a developing device 220 according to the second exemplary embodiment.

The developing device 220 according to this exemplary embodiment is arranged above the photoconductor drum 11. This arrangement is achieved by, for example, rotating the image forming apparatus 1 illustrated in FIG. 1 counterclockwise by 90°. The developing device 220 does not include a spring member between the container 21 and each of the support frames 29L and 29R. Other configuration of the developing device 220 according to this exemplary embodiment is the same as that of the developing device 20 (see FIGS. 2 to 6) according to the first exemplary embodiment.

In the developing device 220 according to this exemplary embodiment, instead of the pressure of the spring members, the force of gravity G acts on the container 21 in proportion to its weight (i.e., the weight of part of the developing device 220 excluding a support frame). The force of gravity G acting downward in the vertical direction from the center of gravity of the container 21 acts on the photoconductor drum 11.

Like the developing device 20 according to the first exemplary embodiment, the developing device 220 according to the exemplary embodiment allows the axes Q1 and Q2 of rotation of the two development rollers 22 and 24 to become non-parallel with the axis O of rotation of the photoconductor drum 11. Thus, all the four tracking rollers 221 and 241 are brought into contact with the corresponding positioning members 112. The container 21 on which the force of gravity G acts inclines in such a direction that all the four tracking rollers 221 and 241 come into contact with the corresponding positioning members 112.

Third Exemplary Embodiment

Next, description will be given on a developing device 320 according to a third exemplary embodiment of the invention that does not use tracking rollers unlike the developing device 20 according to the first exemplary embodiment. In the following description of the third exemplary embodiment, components that are the same as those in the first exemplary embodiment are denoted by the same reference symbols and only the points that are different from those of the above-described exemplary embodiments will be described.

Figure 8C:
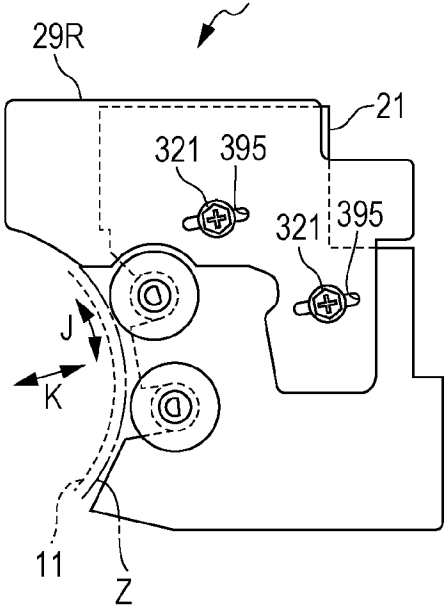
FIGS. 8A, 8B, and 8C illustrate a support structure of a developing device according to a third exemplary embodiment, where
Figure 8B:
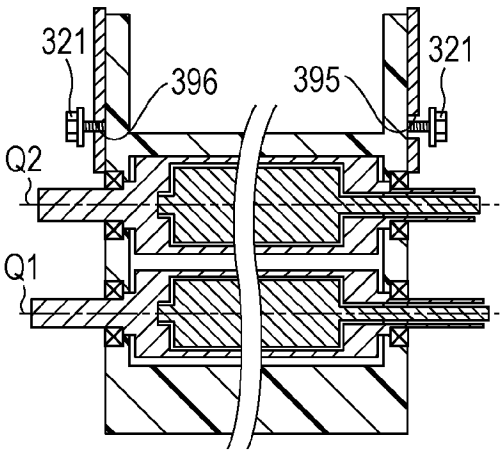
Figure 8A:
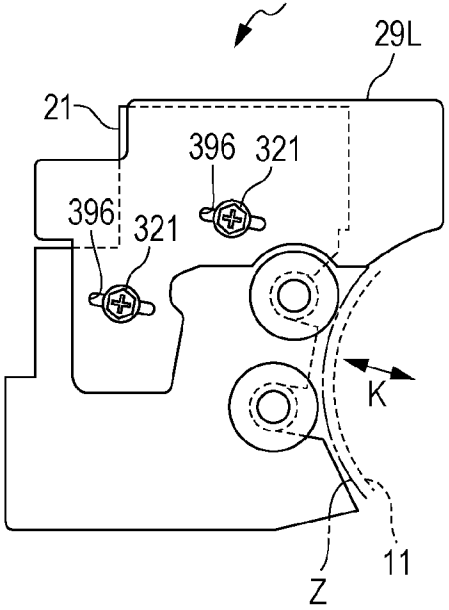

FIGS. 8A, 8B, and 8C illustrate a support structure of the developing device 320 according to the third exemplary embodiment, where FIG. 8A is a left-side view, FIG. 8B is a cross-sectional view, and FIG. 8C is a right-side view.

In the developing device 320 according to this exemplary embodiment, the container 21 is secured to the support frames 29L and 29R by four fixing screws 321, and does not include any tracking roller. Thus, the photoconductor drum 11 does not include the positioning members 112 (FIG. 3) according to the first exemplary embodiment.

The developing device 320 does not include a spring member between the container 21 and each of the support frames 29L and 29R. Other configuration of this exemplary embodiment is the same as that of the first exemplary embodiment.

In the developing device 320 according to this exemplary embodiment, a gap between the photoconductor drum 11 and each of the first and second development rollers 22 and 24 is set during a process of manufacturing the image forming apparatus 1 or during replacement of the developing device 320. For example, during the manufacturing process, first, a flexible plate-like jig Z having a predetermined thickness is disposed between the photoconductor drum 11 and each of the two development rollers 22 and 24. Then, the container 21 is pressed against the photoconductor drum 11 such that the jig Z is sandwiched between the photoconductor drum 11 and each of the two development rollers 22 and 24. Subsequently, while the container 21 is kept being pressed, the fixing screws 321 are tightened to secure the container 21 to the support frames 29L and 29R. Finally, the jig Z is removed from between the photoconductor drum 11 and each of the two development rollers 22 and 24. Thus, a gap having a size that is equivalent to the thickness of the jig Z is formed between the photoconductor drum 11 and the two development rollers 22 and 24.

FIGS. 8A, 8B, and 8C illustrate the state before the fixing screws 321 are tightened. The fixing screws 321 penetrate through holes 395 and 396 formed in the support frames 29L and 29R and engage with the side walls 21L and 21R of the container 21. The long holes 396 formed in the left support frame 29L, which is one of the two support frames 29L and 29R, longitudinally extend toward the photoconductor drum 11, and have a width that is equivalent to the diameter of the fixing screws 321. On the other hand, the wide holes 395 formed in the right support frame 29R, which are so-called clearance holes, longitudinally extend toward the photoconductor drum 11, and the width of the wide holes 395 in the circumferential direction J of the photoconductor drum 11 is larger than the diameter of the fixing screws 321. The right fixing screws 321 secured to the right side wall of the container 21 are thus movable both in the drum direction K and the circumferential direction J. Specifically, before the fixing screws 321 are tightened, the support frames 29L and 29R support the container 21 while allowing the axes Q1 and Q2 of rotation of the two development rollers 22 and 24 to become non-parallel with the axis O of rotation (see FIG. 4) of the photoconductor drum 11. Here, the fixing screws 321 are exemplary fixing devices in the invention, and the wide holes 395 are exemplary fixing-device-receiving parts in the invention.

In the case, for example, where the container 21 moves only in the drum direction K, when the container 21 is pressed against the photoconductor drum 11 before the fixing screws 321 are tightened, one of four end portions of the two development rollers 22 and 24 may be separated from the jig Z due to allowances. Specifically, one of the two development rollers 22 and 24 may be obliquely raised above the surface of the jig Z.

In the developing device 320 according to the exemplary embodiment, on the other hand, all the four end portions of the two development rollers 22 and 24 are brought into contact with the jig Z with the axes Q1 and Q2 of rotation of the two development rollers 22 and 24 becoming non-parallel with the axis O of rotation of the photoconductor drum 11. When the fixing screws 321 are tightened in this state and the jig Z is then removed, a gap having a size that is equivalent to the thickness of the jig Z is formed between the photoconductor drum 11 and each of the two development rollers 22 and 24. Attaching of the container 21 with the fixing screws 321 does not involve an operation such as temporary holding of the container 21 before the container 21 actually becomes attached unlike in the case where the container 21 is fastened with an adhesive, for example.

In the third exemplary embodiment, the wide holes 395 of the support frame 29R through which the screws 321 penetrate are illustrated as exemplary fixing-device-receiving parts in the invention. The present invention, however, is not limited thereto. Alternatively, for example, wide holes through which fixing screws penetrate may be formed in the container and the fixing screws may engage with the fixed member.

As in the case of the first exemplary embodiment, the developing device 320 disposed on the side of the photoconductor drum 11 is illustrated in the third exemplary embodiment as an exemplary developing device in the invention. However, the present invention is not limited thereto. A developing device in which side walls of a container are fastened to the fixed member with fixing screws may be arranged above the subjected-to-development member, as in the case of the second exemplary embodiment.

In the second exemplary embodiment, the developing device 220 arranged above the photoconductor drum 11 is illustrated as an exemplary developing device in the invention. However, the present invention is not limited thereto. The developing device may be disposed obliquely above the subjected-to-development member. Alternatively, the developing device may be disposed obliquely above the subjected-to-development member and may include pressing members that press the container as in the case of the first exemplary embodiment. Among the developing devices in the invention, a developing device including a pressing member may be disposed below the subjected-to-development member.

In the above-described exemplary embodiments, a case where one of the two support frames has a wide hole is illustrated. The present invention, however, is not limited thereto, and wide holes may be formed in both the two support frames.

In the first and second exemplary embodiments, the tracking rollers 221 and 241 that are brought into contact with the positioning members 112 are illustrated as exemplary gap retainers in the invention. The present invention, however, is not limited thereto. For example, the gap retainers may be tracking rollers that are directly brought into contact with the subjected-to-development member. The gap retainers are not limited to bearings mounted on the shaft portions 22*a* and 24*a* and may be, for example, portions formed by expanding the diameter of development rollers so as to be continuous with the circumferential surfaces of the development rollers.

In the second exemplary embodiment, the case where the container is supported by two support frames is illustrated. The present invention, however, is not limited thereto, and a container that is positioned by using the force of gravity acting thereon in proportion to its weight does not have to include support frames.

In the second exemplary embodiment, the spring members 201 and 203, which are compression springs, are illustrated as exemplary pressing members in the invention. The present invention, however, is not limited thereto, and the pressing member may be a tension spring or a rubber product, for example.

In the second exemplary embodiments, the fixing screws 321 are illustrated as exemplary fixing devices in the invention and the wide holes 395 are illustrated as exemplary fixing-device-receiving parts in the invention. The present invention, however, is not limited thereto, and the fixing device and the fixing-device-receiving part may be used in, for example, pressure bonding or welding or fixing using an adhesive agent.

In the above-descried exemplary embodiments, a configuration in which a charging roller and a laser exposing device are included is illustrated as an exemplary image forming apparatus in the invention. The image forming apparatus in the invention, however, is not limited thereto, and may include, for example, a corona discharge device such as a corotron or scorotron instead of the charging roller or may include an array of multiple light emitting diodes instead of the laser exposing device. Alternatively, the image forming unit in the invention may be, for example, the one that directly applies a voltage corresponding to an image to an image carrier by using an electrode array.

In the above-described exemplary embodiments, a tandem color printer is illustrated as an exemplary image forming apparatus. The image forming apparatus in the invention, however, is not limited thereto, and may be a single-color printer that does not include an intermediate transfer belt.

In the above-described exemplary embodiments, a printer is illustrated as an exemplary image forming apparatus. The image forming apparatus in the invention, however, is not limited to a printer, and may be a copying machine or a fax machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

two developer-transporting members that are arranged side by side such that circumferential surfaces of the developer-transporting members face a cylindrical subjected-to-development member that is rotatably supported by a supporter, each of the developer-transporting members rotating in a circumferential direction of the circumferential surface while carrying a developer on the circumferential surface to transport the developer to a surface of the subjected-to-development member on which an electrostatic latent image is formed and then developed with the developer;

a fixed member that includes a first hole with a first dimension and a second hole with a second dimension that is different from the first dimension;

a container including a first support projection that is inserted into the first hole and a second support projection that is inserted into the second hole, the container contains the developer transported by the two developer-transporting members, rotatably supports rotation shafts of the two developer-transporting members using side walls of the container located on both end portions in a direction in which the two developer-transporting members extend; and four gap retainers that are supported at both end portions of the two developer-transporting members, the gap retainers being brought into contact with the subjected-to-development member or the supporter to each maintain a gap between the subjected-to-development member and a corresponding one of the developer-transporting members, wherein a force with which the two developer-transporting members are pressed toward the subjected-to-development member is applied to the container and all the four gap retainers are brought into contact with the subjected-to-development member or the supporter, while axes of rotation of the two developer-transporting members are allowed to become non-parallel with an axis of rotation of the subjected-to-development member due to the difference between the first dimension and the second dimension.

2. The developing device according to claim 1, further comprising:

a pressing member that is interposed between the fixed member and the container, the pressing member pressing the container in such a direction that the two developer-transporting members move toward the subjected-to-development member, and the fixed member is fixed to the supporter.

3. The developing device according to claim 1, wherein the first dimension is a width of the first hole, and the second dimension is a width of the second hole.

4. An image forming apparatus, comprising:

a cylindrical subjected-to-development member having a surface on which an electrostatic latent image is formed and then developed by a developer;

a supporter that rotatably supports the subjected-to-development member; and a developing device that develops the subjected-to-development member, wherein the developing device includes:

two developer-transporting members that are arranged side by side such that circumferential surfaces of the developer-transporting members face the subjected-to-development member, each of the developer-transporting members rotating in a circumferential direction of the circumferential surface while carrying a developer on the circumferential surface to transport the developer to the surface of the subjected-to-development member;

a container that contains the developer transported by the two developer-transporting members, the container rotatably supporting rotation shafts of the two developer-transporting members using side walls of the container located on both end portions in a direction in which the two developer-transporting members extend; and first and second gap retainers that are supported at respective end portions of one of the two developer-transporting members, third and fourth gap retainers that are supported at respective end portions of the other one of the two developer-transporting members, the first through fourth gap retainers being brought into contact with the subjected-to-development member or the supporter to each maintain a gap between the subjected-to-development member and a corresponding one of the developer-transporting members; and wherein a force with which the two developer-transporting members are pressed toward the subjected-to-development member is applied to the container and each of the first through fourth four gap retainers are brought into contact with the subjected-to-development member or the supporter, while axes of rotation of the two developer-transporting members are allowed to become non-parallel with an axis of rotation of the subjected-to-development member, and wherein the first and second gap retainers have a same size.

5. The image forming apparatus according to claim 4, wherein the third and fourth gap retainers have a same size.

6. A developing device comprising:

two developer-transporting members that are arranged side by side such that circumferential surfaces of the developer-transporting members face a cylindrical subjected-to-development member that is rotatably supported by a supporter, each of the developer-transporting members rotating in a circumferential direction of the circumferential surface while carrying a developer on the circumferential surface to transport the developer to a surface of the subjected-to-development member, on which an electrostatic latent image is formed and then developed with the developer;

a container that contains the developer transported by the two developer-transporting members, the container rotatably supporting rotation shafts of the two developer-transporting members using side walls of the container located on both end portions in a direction in which the two developer-transporting members extend;

a fixed member that is fixed to the supporter; and a fixing device that fixes the side walls of the container to the fixed member, wherein either one of the fixed member and the container includes a fixing-device-receiving part through which the fixing device extends, wherein dimensions of the fixing-device-receiving part permit the fixing device to move in a first direction and a second direction that intersects the first direction, wherein the fixing-device-receiving part and the fixing device fix the container to the fixed member, and allow the container to be positioned such that axes of rotation of the two developer-transporting members become non-parallel with an axis of rotation of the subjected-to-development member and such that the two developer-transporting members are inclined in a circumferential direction of the subjected-to-development member.

7. The developing device according to claim 6, wherein the fixing device is a screw having a first diameter, and the fixing-device-receiving part is a hole having a second diameter and through which the screw penetrates, and wherein second diameter is greater than the first diameter.

8. An image forming apparatus comprising:

a cylindrical subjected-to-development member having a surface on which an electrostatic latent image is formed and then developed by a developer;

a supporter that rotatably supports the subjected-to-development member; and a developing device that develops the subjected-to-development member, wherein the developing device includes:

two developer-transporting members that are arranged side by side such that circumferential surfaces of the developer-transporting members face the subjected-to-development member, each of the developer-transporting members rotating in a circumferential direction of the circumferential surface while carrying a developer on the circumferential surface to transport the developer to the surface of the subjected-to-development member;

a container that contains the developer transported by the two developer-transporting members, the container rotatably supporting rotation shafts of the two developer-transporting members using side walls of the container located on both end portions in a direction in which the two developer-transporting members extend;

a fixed member that is fixed to the supporter; and a fixing device with which the side walls of the container are fixed to the fixed member, and wherein either one of the fixed member and the container includes a fixing-device-receiving part, the fixing-device-receiving part and the fixing device fix the container to the fixed member, and wherein a size differential between the fixing-device-receiving part and the fixing device permits the container to be positioned such that axes of rotation of the two developer-transporting members become non-parallel with an axis of rotation of the subjected-to-development member and such that the two developer-transporting members are inclined in a circumferential direction of the subjected-to-development member.

9. The image forming apparatus according to claim 8, wherein the fixing device is a screw and the fixing-device-receiving part is a hole through which the screw penetrates.

* * * * *